US008499953B1

(12) United States Patent
Town

(10) Patent No.: US 8,499,953 B1
(45) **Date of Patent: *Aug. 6, 2013**

(54) CONTAINMENT BAG FOR USE IN A COMMERCIAL DISPOSAL CONTAINER

(75) Inventor: Troy Town, Clinton, LA (US)

(73) Assignee: PacTec, Inc., Clinton, LA (US)

( * ) Notice: Subject to any disclaimer, the term of this patent is extended or adjusted under 35 U.S.C. 154(b) by 146 days.

This patent is subject to a terminal disclaimer.

(21) Appl. No.: 11/473,673

(22) Filed: Jun. 23, 2006

Related U.S. Application Data

(63) Continuation of application No. 10/393,552, filed on Mar. 21, 2003, now Pat. No. 7,073,676, which is a continuation of application No. 09/930,408, filed on Aug. 15, 2001, now abandoned.

(51) Int. Cl.
*B65D 90/04* (2006.01)

(52) U.S. Cl.
USPC ..... 220/1.6; 220/495.06; 383/61.3

(58) Field of Classification Search
CPC ..... B65D 90/04
USPC ..... 383/61.1, 61.3
See application file for complete search history.

(56) References Cited

U.S. PATENT DOCUMENTS 525,951 A * 9/1894 Flaniken ..... 294/75
977,698 A 12/1910 Barksdale
2,215,689 A 9/1940 Dickson
2,216,527 A 10/1940 Weiss et al.
2,524,584 A 10/1949 Zehr
2,574,345 A 11/1951 Montgomery
2,683,262 A 7/1954 Foss
2,712,797 A 7/1955 Woehrle et al.
2,861,735 A 11/1958 Faltin
2,883,041 A * 4/1959 Pfeifer et al. ..... 206/541
2,998,340 A 8/1961 Conway et al.
3,167,209 A 1/1965 Jones
3,219,240 A 11/1965 Campbell, Jr.
3,306,328 A 2/1967 Markus
3,422,867 A 1/1969 Wu
3,459,357 A 8/1969 Egger et al.
3,468,102 A 9/1969 Farrar et al.
3,481,461 A 12/1969 Paxton
3,539,360 A 11/1970 Wood
3,570,751 A 3/1971 Trewella
3,578,213 A 5/1971 Clarke et al.
3,617,418 A 11/1971 Miller
3,756,469 A 9/1973 Clark et al.
3,834,528 A 9/1974 Pickford et al.
3,888,163 A 6/1975 Watanabe
1,893,595 A 7/1975 Khanna et al.
3,987,959 A 10/1976 Deards et al.
4,194,652 A 3/1980 Williamson et al.
4,207,937 A 6/1980 Sandeman et al.
4,385,953 A 5/1983 Beck
4,395,067 A 7/1983 Robin
4,461,402 A 7/1984 Fell et al.
4,557,400 A 12/1985 Clarke (Continued)

*Primary Examiner* — Stephen Castellano
(74) *Attorney, Agent, or Firm* — Jones Walker LLP

(57) ABSTRACT

The invention consists of non-self supporting containment bag used in conjunction with a dumpster container. The bag has a zipper or other sealable means, and a series of pick-up or attachment loops or handles may also be attached to the outer bag material. The bag may additionally have an internal lining to resist leakage of fluids or wet materials stored in the container.

15 Claims, 6 Drawing Sheets

U.S. PATENT DOCUMENTS

| | | | | | |
|---|---|---|---|---|---|
| 4,570,820 | A | | 2/1986 | Murphy | |
| 4,671,733 | A | | 6/1987 | Krein | |
| 4,730,942 | A | | 3/1988 | Fulcher | |
| 4,754,914 | A | | 7/1988 | Wischusen, III | |
| 4,759,742 | A | | 7/1988 | Achelpohl | |
| 4,817,824 | A | | 4/1989 | LaFleur et al. | |
| 4,850,508 | A | | 7/1989 | Lee | |
| 4,871,046 | A | | 10/1989 | Turner | |
| 5,041,317 | A | | 8/1991 | Greyvenstein | |
| 5,073,035 | A | | 12/1991 | Williams | |
| 5,110,005 | A | | 5/1992 | Schilling | |
| 5,127,893 | A | | 7/1992 | Lafleur | |
| 5,297,870 | A | * | 3/1994 | Weldon | 383/59 |
| 5,664,887 | A | | 9/1997 | LaFleur | |
| 5,810,478 | A | | 9/1998 | Lafleur | |
| 5,938,338 | A | | 8/1999 | McDonough | |
| 6,029,723 | A | * | 2/2000 | Baquero et al. | 150/105 |
| 6,079,934 | A | * | 6/2000 | Beale | 414/607 |
| 6,155,772 | A | | 12/2000 | Beale | |
| 6,186,713 | B1 | | 2/2001 | Bonerb | |
| 6,250,488 | B1 | | 6/2001 | Narahara et al. | |
| 6,305,845 | B1 | | 10/2001 | Navin | |
| 6,427,475 | B1 | * | 8/2002 | DeFelice et al. | 62/457.2 |
| RE37,915 | E | | 12/2002 | Lapoint, III | |
| 7,073,676 | B1 | * | 7/2006 | Town | 220/1.6 |

* cited by examiner

CONTAINMENT BAG FOR USE IN A COMMERCIAL DISPOSAL CONTAINER

This is a continuation of Ser. No. 10/393,552, filed on Mar. 21, 2003 now U.S. Pat. No. 7,073,676, which is a continuation of Ser. No. 09/930,408, filed on Aug. 15, 2001 now abandoned, to which this application claims priority and which are hereby incorporated by reference in its entirety.

FIELD OF THE INVENTION

This invention relates to containment bags used with large dumpster style disposal containers in the storage, transportation and disposal of wastes.

PRIOR ART

In plant renovations or other type of construction or clean-up projects, wastes are generated and stored in large on-site dumpster—containers, such as rolloff containers, end dump containers, and gondola rail car containers. When hazardous materials (such as tank cleaning sludge, wet or dry waste materials, chemical plant by-products, rail wastes, high heat wastes), odorous materials, or fine particulate matter (for instance, incinerator ashes, powders, asbestos materials) are to be stored in an onsite dumpster container for later transportation and disposal, it is desirable to line the container to protect the container from exposure to the materials and to make later disposal easier. Currently, either large sheets of plastic are used to line the container or container bags are utilized. The existing container bags have openings that are closable using a series of ties or cords. Given the large size of the containers, closing the series of ties can be a time consuming chore. Further, the ties fail to make an effective seal.

SUMMARY OF THE INVENTION

The invention consists of non-self supporting containment bag used in conjunction with a dumpster container. The bag has a zipper or other sealable means and a series of pick-up or attachment loops or handles may also be attached to the outer bag material. The bag may additionally have an internal lining.

OBJECTS OF THE INVENTION

It is an object of the invention to provide a simple easily installable liner for a dumpster container that is sealable.

It is another object to provide a liner for use in a dumpster container having attachment or pick-up handles.

It is another object of the invention to provide a containment bag for use in a dumpster container having a secondary liner on the interior of the containment bag.

DETAILED DESCRIPTION OF THE INVENTION

Figure 1:
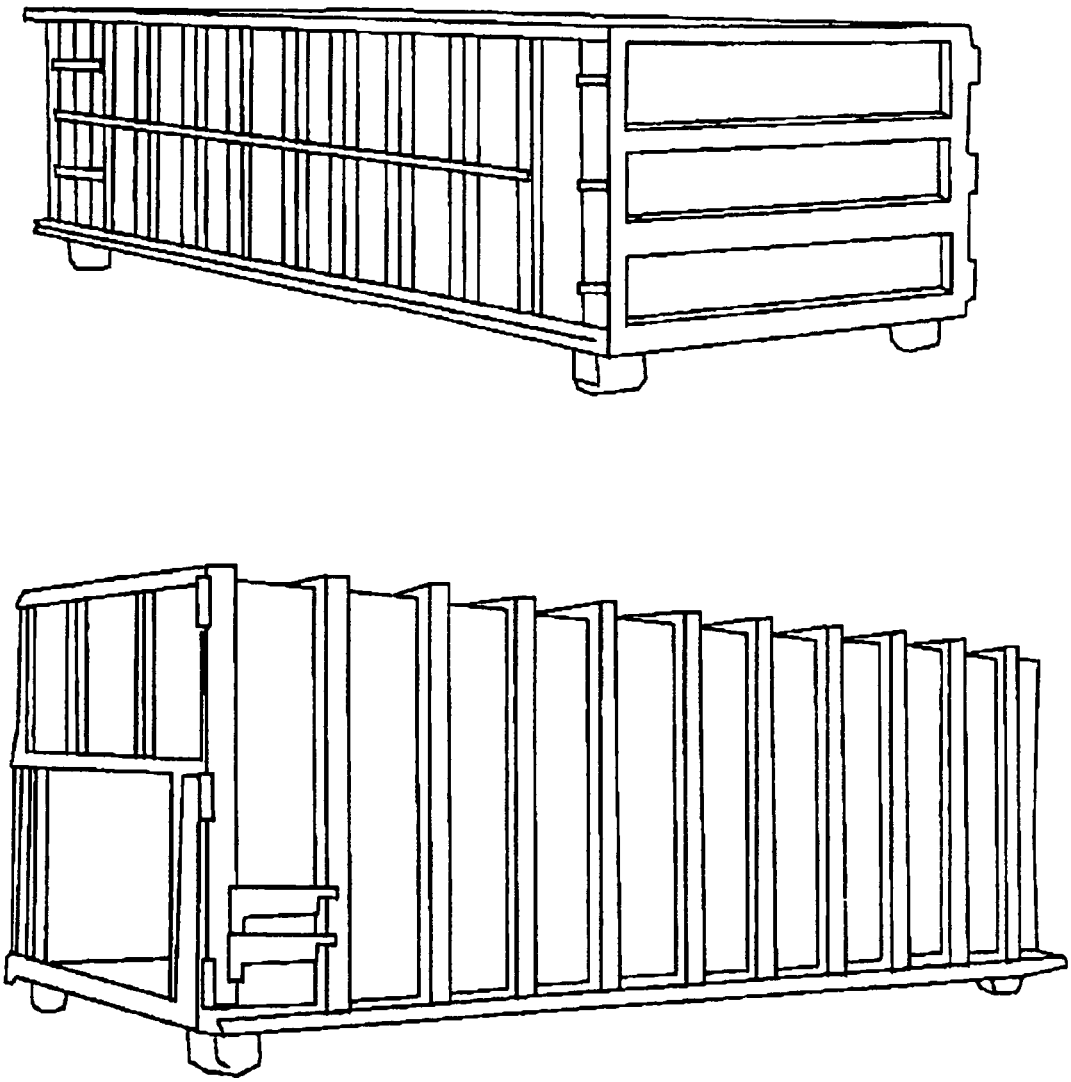
FIG. 1 is a perspective view of a rolloff container.
Figure 2:
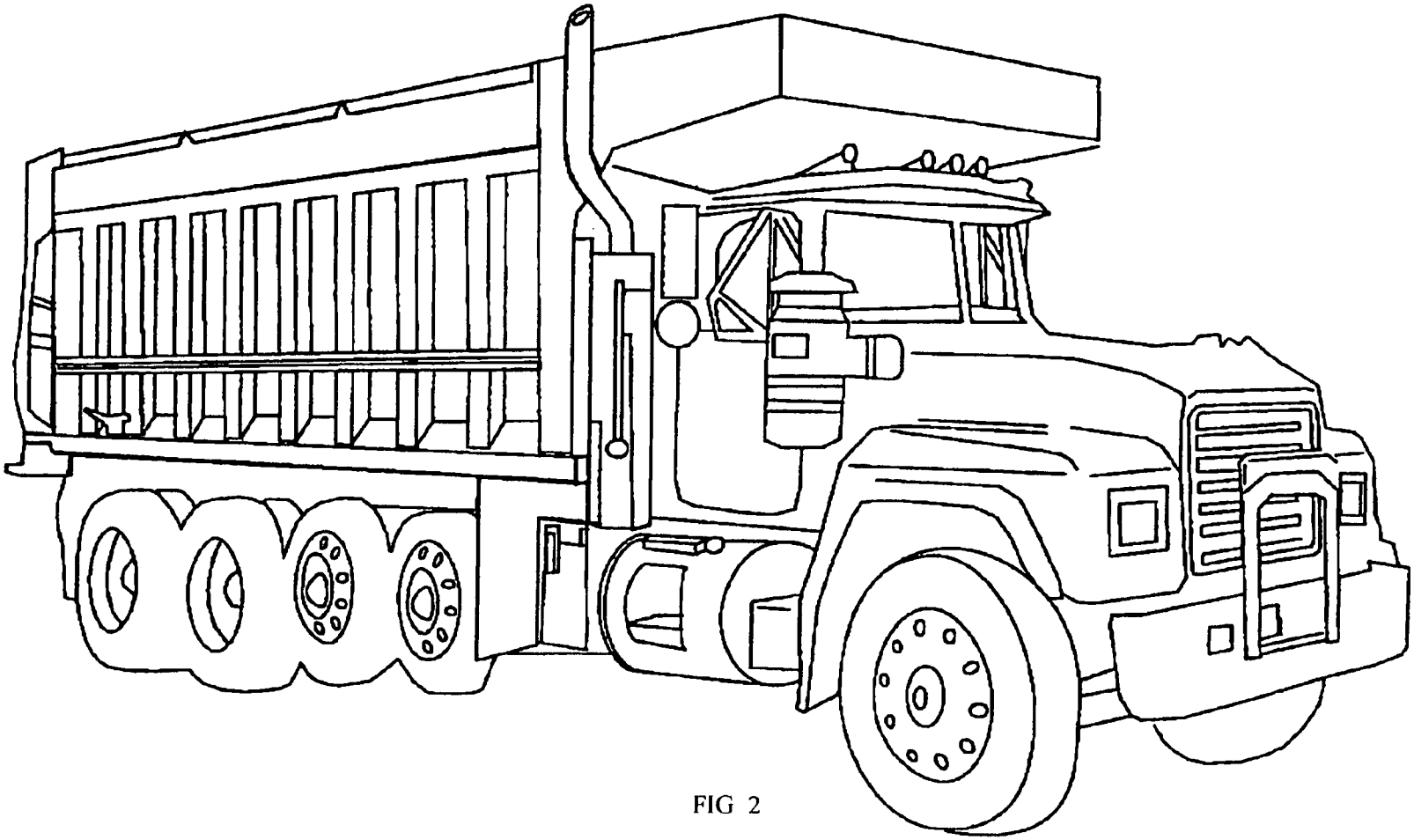
FIG. 2 is a perspective view of an end dump container.
Figure 3:
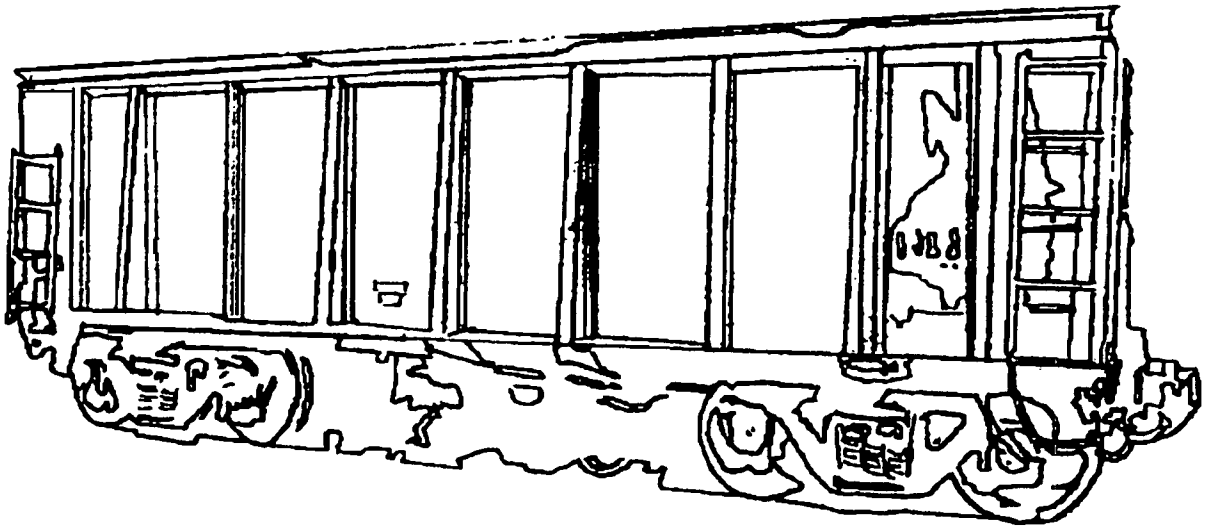
FIG. 3 is a perspective view of a gondola rail car container.
Figure 4:
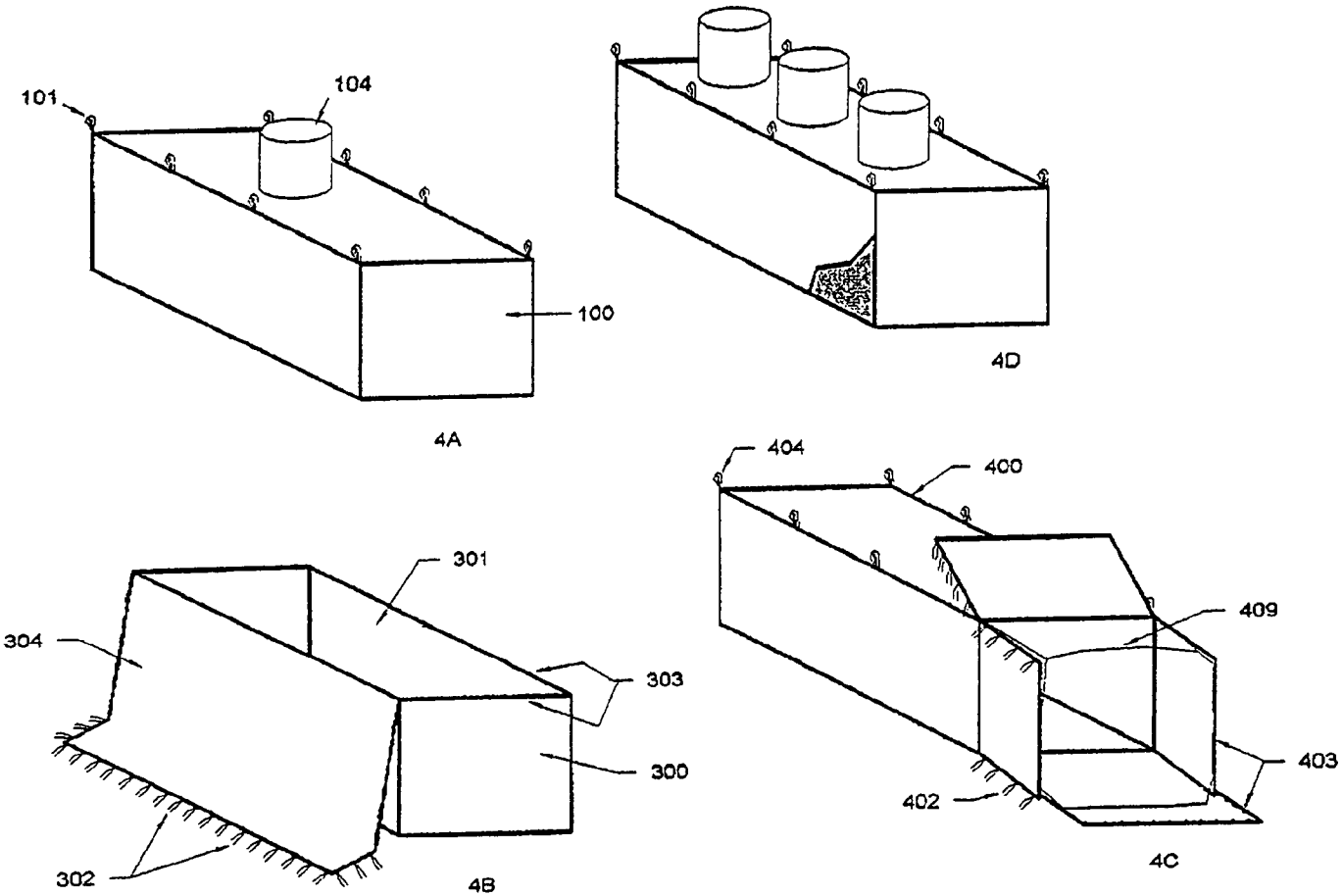
FIG 4 Prior Art
FIG. 4 shows a series of prior art container bags.

Three existing dumpster type containers are shown in FIGS. 1-3: a roll off container (FIG. 1), an end-dump container (FIG. 2) and a rail car gondola (FIG. 3). These containers range in size from 52'×10'×5' for a rail gondola to 22'×7.5'×5' for a 30 yard rolloff container. Shown in FIG. 4 are typical prior art container bags. FIG. 4*a* shows a single spout container bag 100 having a series of grab loops 101. The grab loops 101 are used to attach and support the container bag to a dumpster container. The single spout 104 provides access to the interior of the bag for loading materials into the container bag. After loading, the single spout would be tied shut with a suitable tie, such as a rope. The spout type bag can come with multiple spout configurations as shown in FIG. 4*d*.

FIG. 4*b* shows a prior art cigar top bag 300. The cigar top bag 300 has a top opening 301, which is closable by a cover 304 having a series of ties 302 located around the periphery of the top opening 301. Ties 302 attach to loops 303. FIG. 4*c* shows a prior art bread bag style container bag 400. The bread bag style is similar to the cigar top bag except the opening in the cigar top bag is located on the end instead of the top. Again, the opening is closable by tying a series of ties 402 to a matching series of loops 403. Also shown is a series of handles, shown here shown as loops 404, for attaching and supporting the container bag to a disposal container. Prior art bags are generally constructed of polypropylene and may have an interior lining 409, such as a polyethylene barrier attached to the interior of the bag shell.

Figure 5:
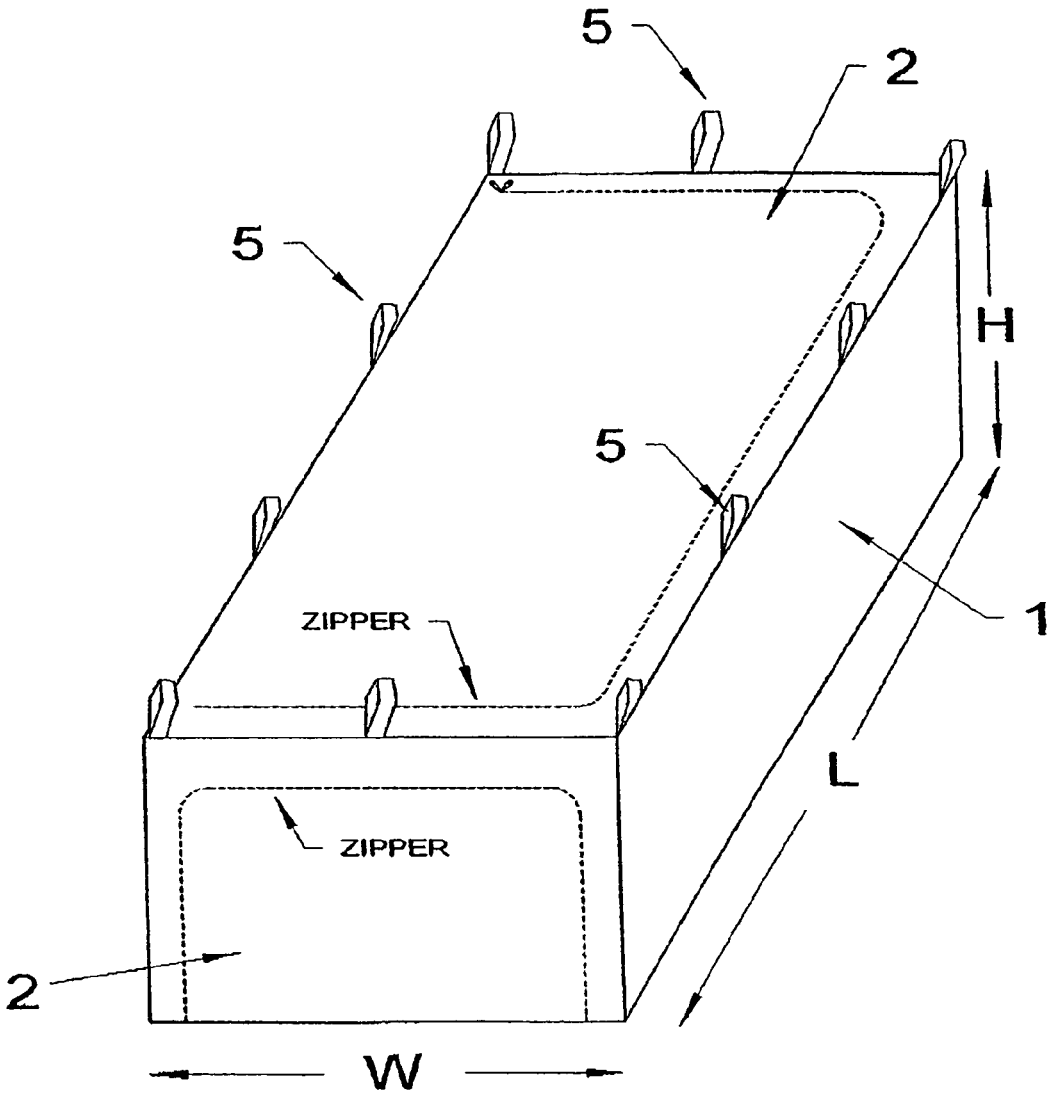
FIG. 5 is a perspective view of the containment bag invention.

Shown in FIG. 5 is containment bag 1. Containment bag 1 is made of a non-self supporting material and is designed to be inserted in a commercial dumpster container. The containment bag 1 may be made of woven or non-woven materials with a 3-5 oz woven polypropylene preferred. Other materials such as polyvinyl chloride (PVC, reinforced or non-reinforced), woven or non-woven polyethylene or other suitable materials, such as woven fiberglass may be used. The bag material may also be coated, such as woven polypropylene bag having a polyethylene coating placed on the interior or exterior of the bag.

The bag should have an opening 2 that is sealingly closable. Bag opening 2 should be placed on the bag for ease of loading and storage of materials and, in some instances, for ease of removal of the stored materials. For instance, the bag shown in FIG. 5 has two sealable openings, one positioned on the top of the bag 3, and one positioned on the side of the bag 4. The two openings are shown for demonstration purposes. In the standard embodiment, a container bag will have a single opening. As shown, the openings are closable with a sealable closing means, such as a zipper. A preferred zipper is a #10 coil nylon zipper, with two pulls positioned on the zipper tracks. Other zipper or zipper types can be used.

Figure 6:
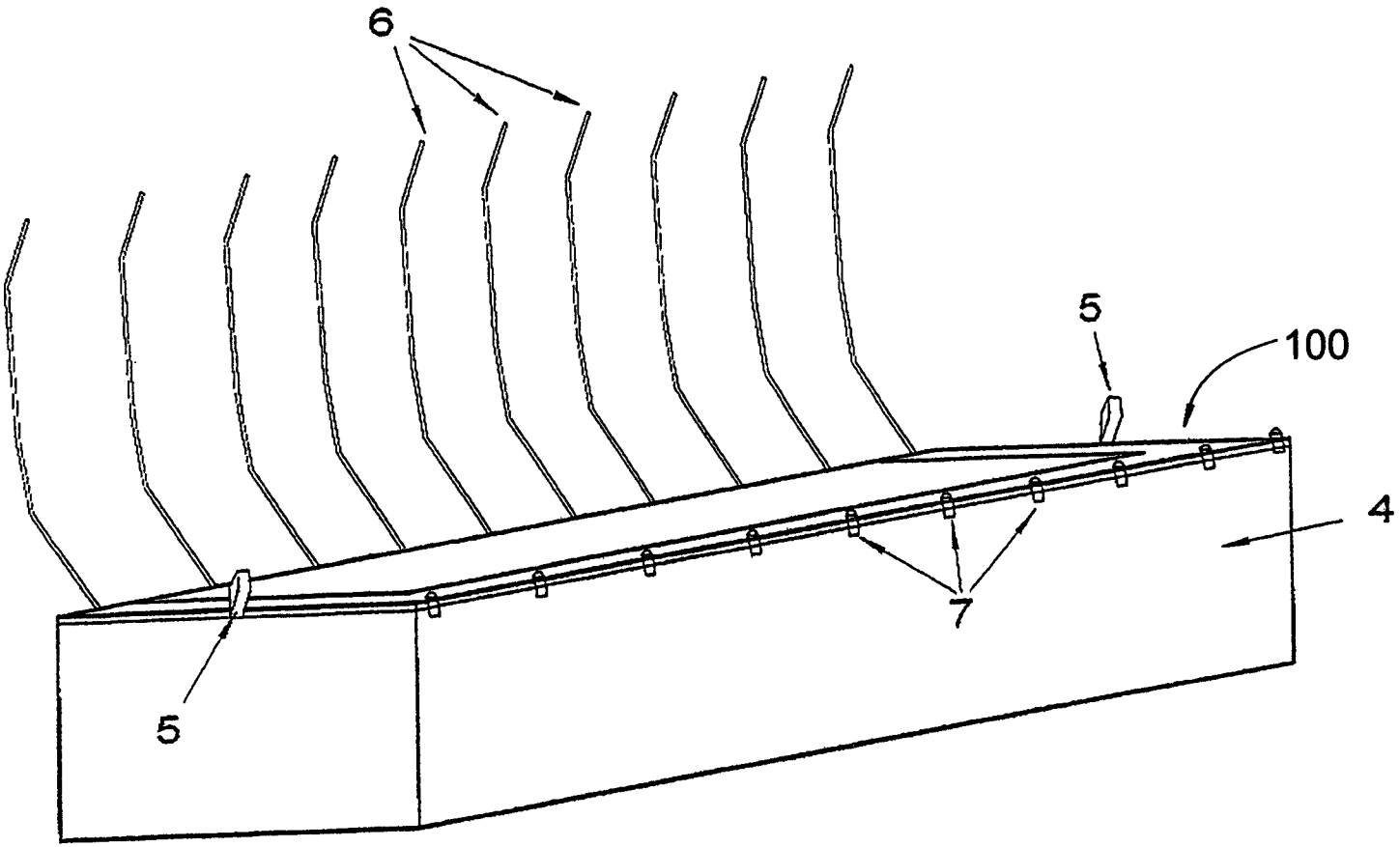
FIG. 6 is a perspective view of another embodiment of the containment bag invention.

Also shown are support handles 5 in FIG. 6, which are positioned near the top perimeter edge 100, and where the opening and zipper are positioned inward of the perimeter edge 100. The support handles 5 can serve two purposes: (1) to attach the bag to the container, and thereby support the bag for fill; and, in some instances, (2) to assist in moving or removal of the bag from the container. Handles 5 can be loops, such as double D-ring straps or 2-inch loops, or lines or ties, and can be made from suitable materials, such as polypropylene or polyester webbing. When used to attach the bag to the container, the handles will attach to points on the container, generally, at least one handle on each corner (see FIGS. 1 and 2 showing containers having a fabric top attached to the container with handles).

Additionally, the bag 1 may incorporate a separate inner liner 10 (not shown). Inner liners are useful when the stored materials are wet or liquids. Suitable material can be low-density polyethylene, with 6-10 mil thickness being preferred. One such liner is disclosed in U.S. Pat. No. 5,110,005, herein incorporated by reference. Inner liner may be sewn to the outer bag, or attached by other means, for instance heat-sealed to the outer bag.

The container bag as shown is intended to be disposed with the stored wastes, and not intended to for re-use.

Shown in FIG. 6 is another embodiment of the container bag 4. Bag 4 is shown having a single top opening, sealable with a zipper. Also shown are loops 5 on one side of the top and a series of straps 6 on the opposite topside. As shown, the matching loops are D-ring loops 7. The straps are of length sufficient to cross the top surface of the bag and tie into loops on the opposite top side. When so secured, these straps help resist "flapping" of the bag top during transport in an open container, such as a railcar gondola.

It is intended that the following claims be interpreted as covering all such alterations and modifications as fall within the true spirit and scope of the invention.

I claim:

1. A containment bag, for use in a dumpster container that includes a plurality of sidewall, an open top and an opposing closed bottom defining a dumpster container interior, for accepting bulk materials, said containment bag comprising:

a bag adapted to fit within and line the interior of a dumpster container, said containment bag having a top portion having a perimeter edge substantially alignable with the open top of the dumpster container, and a sidewall portion and a closed bottom portion;

only one closeable opening, said only one closable opening positioned on said top portion, and a zipper for opening and closing said only one closable opening, said zipper positioned inwardly of said perimeter wall and traversing a U shaped path on said top portion, said zipper, when opened, creates an opening into the interior of said containment bag, said only one closable opening, when opened, being substantially alignable with an open top of the dumpster container when said containment bag is deployed in a dumpster container.

2. The containment bag according to claim 1 wherein said containment bag further has a lining positioned on said interior surface of said containment bag.

3. The containment bag according to claim 1 wherein said containment bag is constructed of a woven material.

4. The containment bag according to claim 3 wherein woven material is woven polypropylene.

5. The containment bag according to claim 3 wherein said woven material further has a coating positioned thereon.

6. The combination of a dumpster container and a containment bag, said dumpster container having a plurality of sidewalls and a bottom extending between said sidewalls, said sidewalls and said bottom defining the container interior, said sidewalls defining an open container top that extends between said sidewalls, said container oriented for loading with said container resting on said bottom, said bottom being closed, said containment bag comprising a bag adapted to fit in said interior of said dumpster container, said containment bag having an exterior surface and an interior surface, a top portion having a perimeter edge, a closed bottom portion and a closed sidewall portion, only one closeable opening, positioned on said top portion, and a zipper for opening and closing said only one closable opening, said zipper positioned inwardly of said perimeter edge and traversing a U shaped path on said top portion and, when opened, creating an opening on said top portion which is substantially aligned with said open container top of said dumpster container and said sidewall portions are adjacent said container sidewalls and said bottom portion is adjacent said container bottom when said containment bag is deployed in said dumpster container.

7. The combination of a dumpster container and a containment bag according to claim 6 wherein said dumpster container is selected from the set of roll off containers, gondola rail car containers and end dump containers.

8. The combination of a dumpster container and a containment bag according to claim 6 wherein said containment bag further has a lining positioned on said interior surface of said containment bag.

9. The combination of a dumpster container and a containment bag according to claim 8 wherein said lining is waterproof.

10. The combination of a dumpster container and a containment bag according to claim 8 wherein said lining comprises a polyethylene lining.

11. The combination of a dumpster container and a containment bag according to claim 6 wherein said containment bag is constructed of a woven material.

12. The combination of a dumpster container and a containment bag according to claim 11 wherein woven material is woven polypropylene.

13. The combination of a dumpster container and a containment bag according to claim 11 wherein said woven material further has a coating positioned thereon.

14. The combination of a dumpster container and a containment bag according to claim 13 wherein said coating comprises a polyethylene coating.

15. The combination of a dumpster container and a containment bag, said dumpster container having a plurality of sidewalls and a closed bottom extending between said sidewalls, said sidewalls and said bottom defining the container interior, said sidewalls defining an open container top that extends between said sidewalls, said container oriented for loading with said container resting on said bottom, said containment bag comprising a bag adapted to fit in said interior of said dumpster container, said containment bag having an exterior surface and an interior surface, a top portion having a perimeter edge, a closed bottom portion and a sidewall portion, and only one opening positioned on said top portion, said only one opening being closable and openable by a zipper positioned inwardly of said perimeter edge and traversing a U shaped path on said top portion, and when opened, creating an opening on said top portion which is substantially aligned with said open container top of said dumpster container when said sidewall portions are adjacent to said container sidewalls and said bottom portion is adjacent to said container bottom when said containment bag is deployed in said dumpster container.

* * * * *